US005292233A

United States Patent [19]

Takenaka et al.

[11] Patent Number: 5,292,233

[45] Date of Patent: Mar. 8, 1994

[54] VARIABLE CAPACITY SWASH PLATE TYPE COMPRESSOR

[75] Inventors: Kenji Takenaka; Hiroaki Kayukawa; Kazuya Kimura, all of Kariya, Japan

[73] Assignee: Kabushiki Kaisha Toyoda Jidoshokki Seisakusho, Aichi, Japan

[21] Appl. No.: 45,506

[22] Filed: Apr. 8, 1993

[30] Foreign Application Priority Data

Apr. 10, 1992 [JP] Japan ..... 4-91094

[51] Int. Cl.[5] ..... F04B 1/12; F16M 23/08

[52] U.S. Cl. ..... 417/222.2; 417/270; 74/60

[58] Field of Search ..... 417/222.2, 222.1, 269, 417/270; 74/60; 92/12.2

[56] References Cited

U.S. PATENT DOCUMENTS

| | | | |
|---|---|---|---|
| 4,037,993 | 7/1977 | Roberts | 417/222.2 |
| 4,073,603 | 2/1978 | Abendschein et al. | 417/212 |
| 4,475,871 | 10/1984 | Roberts | 417/322 |
| 4,664,604 | 5/1987 | Terauchi | 417/222.1 |
| 4,712,982 | 12/1987 | Inagaki et al. | 74/60 |
| 5,201,261 | 4/1993 | Kayukawa et al. | 74/60 |
| 5,228,841 | 7/1993 | Kimura et al. | 417/769 |

*Primary Examiner*—Richard A. Bertsch
*Assistant Examiner*—Peter Korytnyk
*Attorney, Agent, or Firm*—Burgess, Ryan & Wayne

[57] ABSTRACT

A variable capacity swash plate type refrigerant compressor having a swash plate assembly rotatably mounted on a drive shaft and capable of turning around a hinge-ball to change an angle of inclination thereof, and a plurality of pistons reciprocated by the swash plate assembly within a plurality of cylinder bores to implement suction, compression and discharge of refrigerant gas in response to the rotation of the drive shaft, the hinge-ball being formed with a central bore for permitting the drive shaft to extend therethrough, a single spherical outer face, and a pair of flat faces arranged symmetrically with respect to a plane passing the middle of the spherical outer face and perpendicular to the axis of the central bore. The swash plate assembly is provided with a large central bore enclosed by an inner wall having a spherical wall region engageable with the single spherical outer face of the hinge-ball, and a pair of guide recesses for permitting the hinge-ball to be assembled by the guide of the guide recesses.

4 Claims, 4 Drawing Sheets

VARIABLE CAPACITY SWASH PLATE TYPE COMPRESSOR

FIELD OF THE INVENTION

The present invention relates to a variable capacity swash plate type compressor non-exclusively used as a refrigerant compressor for an air-conditioning system for an automobile. More particularly, it relates to an improved construction of a spherical hinge mechanism for pivotally supporting a swash plate in the interior of a variable capacity swash plate type compressor.

DESCRIPTION OF THE RELATED ART

Japanese Unexamined (Kokai) Patent Publication No. 52-96407 (JP-A-'407) discloses a variable capacity swash plate type compressor provided with a hinge-ball element having diametrically opposite spherical outer surface portions on which a swash plate assembly is pivotally supported. The compressor of JP-A-'407 is provided with a compressor housing in which an axial drive shaft is supported to be rotatable about its own axis when driven by an external rotary drive source, i.e., an automobile engine. The drive shaft is provided with a support element mounted thereon so as to be rotated together, and the support element has a portion radially projecting therefrom with regard to the axis of the drive shaft. The support element rotatable with the drive shaft is operatively connected, via another hinge mechanism, to a swash plate base on which a non-rotatable swash plate is mounted via thrust and rotary bearings.

FIG. 6 illustrates the above-mentioned hinge-ball element 81 and the swash plate base 91 of the compressor of JP-A-'407. The hinge-ball element 81 is axially slidably mounted on the drive shaft (not shown in FIG. 6), and is engaged with the swash plate base 91 so that the base 91 is permitted to pivot about the hinge-ball element 81 to thereby change its inclination from a plane perpendicular to the axis of the drive shaft. Namely, the spherical outer surface portions 83, 83 of the hinge-ball element 81 contact an inner spherical surface portion 93 of the swash plate base 91. The non-rotatable swash plate (not shown in FIG. 6) on the swash plate base 91 is connected to a plurality of reciprocatory pistons of the compressor via connecting rods, and the respective reciprocatory pistons slidably reciprocate in corresponding cylinder bores formed in a cylinder block to be equiangularly arranged around and parallel with the axis of the drive shaft. The non-rotatable swash plate wobbles during the rotation of the drive shaft and the swash plate base 91, so as to reciprocate the respective pistons in the cylinder bores.

The compressor of JP-A-'407 further has a crank chamber, which is defined in the compressor housing, and fluidly communicated with a suction chamber for receiving the refrigerant gas before compression, via a bore-like passageway formed in the cylinder block. The fluid communication between the crank chamber and the suction chamber is controlled by a valve element arranged in the passageway.

When the drive shaft of the compressor of JP-A-'407 is rotated together with the swash plate base 91 arranged at an inclination angle with regard to the plane perpendicular to the axis of the drive shaft, the rotation of the swash plate base 91 generates a wobbling motion of the swash plate. Thus, the wobbling motion of the swash plate causes reciprocation of the respective pistons in the corresponding cylinder bores to thereby implement suction of refrigerant gas from the suction chamber into the respective cylinder bores, compression of the refrigerant gas, and the discharge of the compressed refrigerant gas from the cylinder bores toward the discharge chamber.

In the described variable capacity swash plate type compressor of JP-A-'407, the swash plate base 91 and the hinge-ball 81 are engaged with each other via a slidable contact between the spherical outer surface portions 83 of the hinge-ball 81 and the spherical inner surface portion 93 formed inside a flange portion 92 of the swash plate base 91. Namely, the spherical inner surface portion 93 of the swash plate base 91 is recessed in the inner wall of the flange portion 92 to extend annularly.

The hinge-ball element 81 is provided with the above-mentioned diametrically opposed two spherical outer surface portions 83, a central bore 82 for enabling the hinge-ball element to be slidably mounted on the drive shaft, and two diametrically opposed cylindrical outer surface portions 84 arranged between the two spherical outer surface portions 83. The two diametrically opposed cylindrical outer surface portions 84 of the hinge-ball element 81 are used for assembling the hinge-ball element 81 in the above-mentioned spherical inner surface portion 93 of the swash plate base 91. When assembling, the hinge-ball element 81 is initially set at a horizontal posture, as shown by chain lines in FIG. 6, and inserted inside the flange portion 92 of the swash plate base 91 so that the center of the bore 82 is approximately in alignment with the center of the spherical inner surface portion 93. Subsequently, the hinge-ball element 81 is turned to an erected position where the two spherical outer surface portions 83 of the hinge-ball element 81 are engaged with the spherical inner surface portion 93 of the swash plate base 91. Thereafter, the assembly of the swash plate base 91 and the hinge-ball element 81 is mounted on the drive shaft by inserting the shaft into the central bore 82 of the hinge-ball element 81.

Nevertheless, according to the above-mentioned construction of the compressor of JP-A-'407, the hinge-ball element 81 must be provided with two kinds of round portions, i.e., the spherical outer surface portions 83, 83 and the cylindrical outer surface portions 84, 84. Therefore, production of the hinge-ball element 81 is very difficult and troublesome, and accordingly, a high manufacturing cost of the hinge-ball element per se and the entire assembly of the compressor cannot be avoided.

SUMMARY OF THE INVENTION

An object of the present invention is therefore to provide an improved construction of the assembly of a hinge-ball element and a swash plate base of a variable capacity swash plate type refrigerant compressor, whereby the construction of the hinge-ball element is simplified to make it easier to mechanically produce or manufacture the same.

Another object of the present invention is to provide a less expensive variable capacity swash plate type refrigerant compressor.

In accordance with the present invention, there is provided a variable capacity swash plate type refrigerant compressor which includes:

a compressor housing means defining therein a suction chamber for receiving a refrigerant gas to be compressed, a discharge chamber for receiving the refrigerant gas after compression, a crank chamber capable of functioning as a capacity control chamber, and a plurality of cylinder bores;

a plurality of piston elements received in the cylinder bores of the compressor housing means to be reciprocated therein, the piston elements having one end acting as compressing head and the other end axially opposite to the compressing head, respectively;

an axial drive shaft rotatably supported by the compressor housing means, and extended axially through the crank chamber of the compressor housing means;

a rotary support means fixed to the drive shaft so as to be rotated together with the drive shaft within the crank chamber, the rotary support means being provided with a support arm thereof arranged in the crank chamber;

a hinge-ball means axially slidably mounted on the drive shaft;

a swash plate means in the form of a generally hollow cylindrical means mounted around the drive shaft and pivotally connected to the support arm of the rotary support means, the swash plate means being slidably engaged with the hinge-ball means so as to change an angle of inclination thereof with regard to a plane perpendicular to the axis of the axial drive shaft, and provided with a disk-like swash plate operatively connected to the plurality of piston elements so as to reciprocate the piston elements in the cylinder bores in response to the rotation of the drive shaft, and;

a control means for controlling a pressure level prevailing in the crank chamber and capable of adjustably changing the angle of inclination of the swash plate means to thereby vary the compression and discharge capacity of the compressor;

wherein the hinge-ball means is provided with a single spherical outer face spherically engageable with a central bore of the swash plate means, a central bore in which the axial drive shaft is slidably fit, and a pair of axially opposite flat faces arranged symmetrically with regard to a plane perpendicular to the axis of the central bore of the hinge-ball means and extending through the middle position of the single spherical outer face, and, wherein the swash plate means in the form of the hollow cylindrical means is provided with a central bore enclosed by an inner axial wall, the inner wall of the swash plate means being provided with at least a spherical wall region capable of spherically engaging the single spherical outer face of the hinge-ball means, and a pair of guide recesses for permitting the hinge-ball means to be inserted into the central bore of the swash plate means from an end thereof in such a manner that the flat faces of the hinge-ball means are slidably guided by the guide recesses when the hinge-ball means is assembled in the swash plate means.

When the hinge-ball means is assembled in the swash plate means, the hinge-ball means is inserted into the central bore of the swash plate means in a manner such that the flat faces of the hinge-ball means are smoothly guided by the guide recesses of the swash plate means. When the single spherical outer face of the hinge-ball means faces the spherical wall region of the inner wall of the central bore of the swash plate means, the hinge-ball means is turned so that single spherical outer face of the hinge-ball means is engaged with the spherical wall region of the swash plate means.

The hinge-ball means having the single spherical outer face can make it easy to mechanically produce the hinge-ball means. Thus, the hinge-ball means can be manufactured at a low manufacturing cost.

BRIEF DESCRIPTION OF THE DRAWINGS

The above and other objects, features and advantages of the present invention will be made more apparent from the ensuing description of a preferred embodiment thereof, in conjunction with the accompanying drawings wherein.

DESCRIPTION OF THE PREFERRED EMBODIMENT

Figure 1:
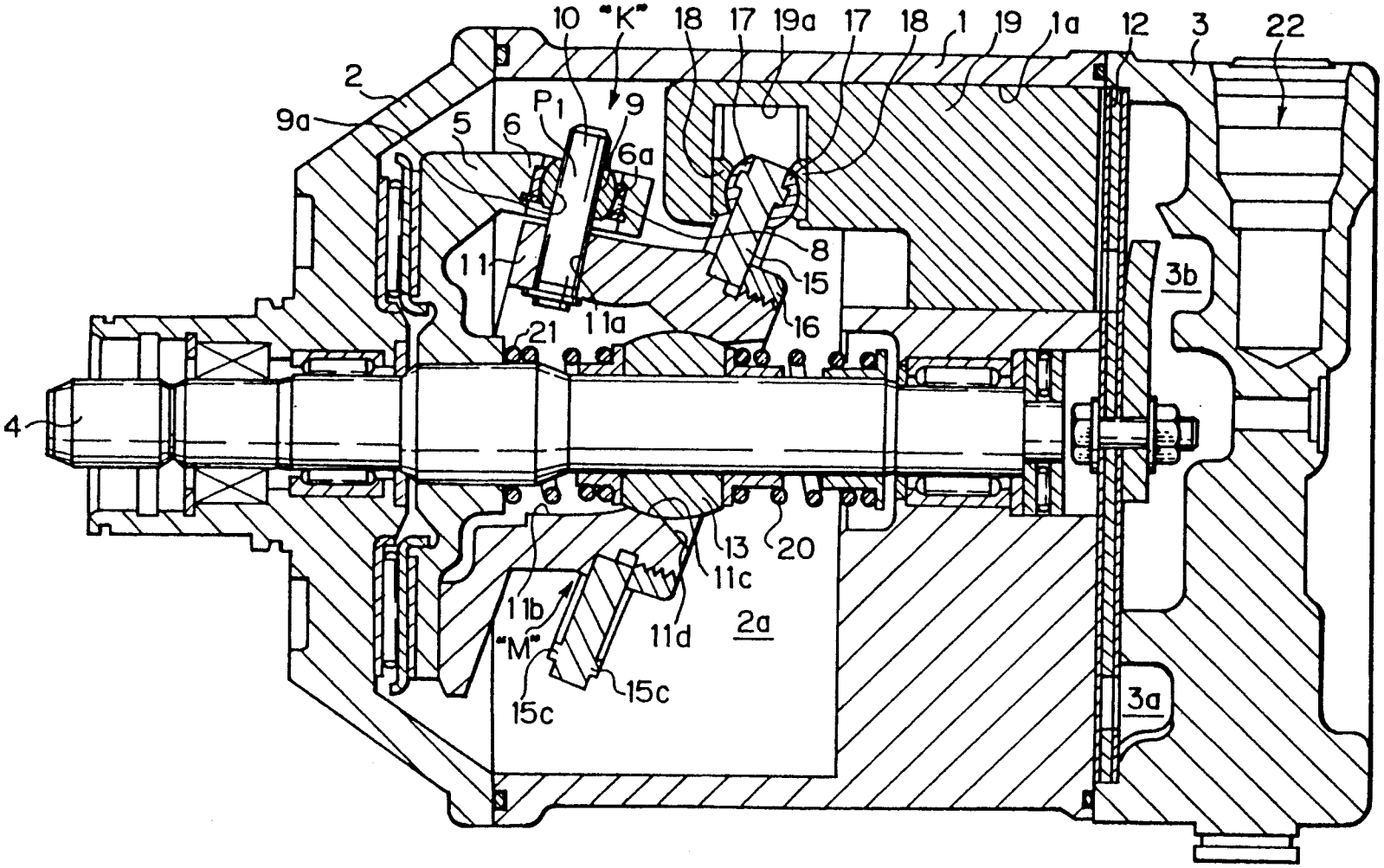
FIG. 1 is a longitudinal cross-sectional view of a variable capacity swash plate type refrigerant compressor according to an embodiment of the present invention.

Referring to FIG. 1, the variable capacity swash plate type refrigerant compressor for an automobile air-conditioner is provided with a cylinder block 1 having a plurality of axial cylinder bores la formed therein.

The cylinder block 1 is provided with a cylindrical crank chamber 2*a* defined therein, a front end sealingly closed by a front housing 2, and a rear end sealingly closed by a rear housing 3 via a valve plate element 12. The rear housing 3 is provided with a suction chamber 3*a* formed therein for receiving refrigerant gas to be compressed, and a discharge chamber 3*b* formed therein for receiving the refrigerant gas after compression. The suction and discharge chambers 3*a* and 3*b* are capable of being communicated with respective cylinder bores 1*a* through opening of suction or discharge valves.

The cylinder block 1 is also provided with an axial central bore in which one end of a drive shaft 4 is supported by radial and thrust bearings. The drive shaft 4 axially extends through the crank chamber 2*a*, and the other end of the drive shaft 4 is supported in a central bore of the front housing 2 by a radial bearing.

A rotary support element 5 is mounted on the drive shaft 4 to be rotated together while being axially supported by a thrust bearing seated on the inner face of the front housing 2. The rotary support element 5 is provided with a support arm 6 projecting rearward in the crank chamber 2*a*, and the support arm 6 is connected to a swash plate base 11 in the form of a hollow element, via a hinge mechanism generally designated by "K". Namely, the support arm 6 of the rotary support element 5 is provided with a through-hole 6*a* formed therein to fixedly receive a socket element 8 having an inner spherical recess therein, and the socket element 8 slidably receives a ball 9 having a guide through-bore 9*a* in which a guide pin element 10 extending from the swash plate base 11 is axially slidably engaged. The guide pin 10 is fixed to the swash plate base 11 by being mounted in a mounting hole 11*a* of the swash plate base 11 in a press-fit manner. Thus, the hinge mechanism K includes the socket element 8, the ball 9, and the axially slidable guide pin 10.

The swash plate base 11 in the form of a generally cylindrical element is provided with a rear portion to which a swash plate 15 is fixed by a threaded clamp element 16 threadedly engaged with male screw threads formed in the rear portion of the swash plate base 11. It should be noted that the swash plate base 11 and the swash plate 15 form a swash plate assembly M capable of operating as a rotation-to-linear motion converter of the compressor.

The swash plate 15 in the form of a generally round disk is provided with an outer periphery having a pair of circular support rails 15c formed on the opposite faces of the swash plate 15. The circular support rails 15c of the swash plate 15 are arranged so as to extend circularly about a center disposed on the axis of the drive shaft 4, and are slidably engaged in the corresponding circular grooves of a pair of shoes 17 having a generally cylindrical outer shape, respectively. Although the shoes 17 are prevented from being radially displaced on respective faces of the swash plate 15 with respect to the center of the swash plate 15, they are slidably engaged with a pair of socket-shoes 18 having a cylindrical inner face formed therein, respectively. Each socket-shoe 18 has a cylindrical outer face extending radially with respect to the axis of the drive shaft 4. The pair of socket-shoes 18 are radially slidably engaged in respective radially cylindrical recesses formed in the opposite faces of a cut 19a formed in an end of each piston element 19 slidably fit in one of the cylinder bores 1a. The cut 19a is provided for permitting the outer periphery of the swash plate 15 to pass therethrough during the rotation of the swash plate assembly M. Thus, the swash plate assembly M is operatively joined to the plurality of piston elements 19 via the shoes 17 and the socket-shoes 18, and accordingly, the rotation of the swash plate 15 of the swash plate assembly M causes reciprocation of respective piston elements 19 in the corresponding cylinder bores 1a.

The hollow swash plate base 11 of the swash plate assembly M is further provided with a large central bore 11b through which the drive shaft 4 extends axially, and the inner wall surrounding the central bore 11b of the swash plate base 11 has a rear portion formed in a spherical wall region 11c for receiving a later-described hinge-ball 13, and a conical wall region 11d expanding rearward to the rearmost end of the swash plate base 11. The spherical wall region 11c of the inner wall of the swash plate base 11 has a predetermined diameter substantially corresponding to that of the hinge-ball 13, and is contiguous with the conical wall region 11d.

Figure 2A:
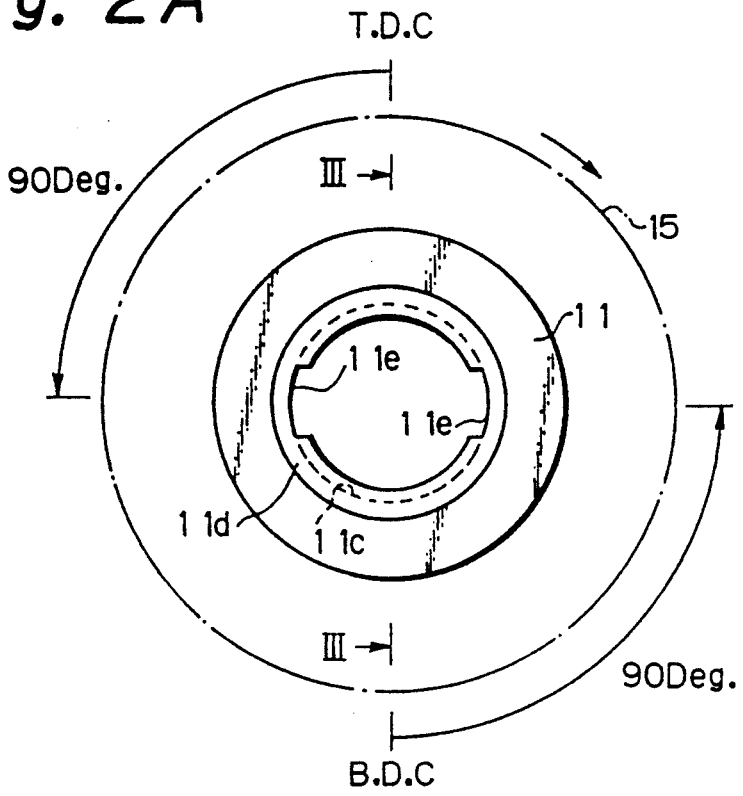
FIG. 2A is a front view of an important portion of a swash plate base to be incorporated into the compressor of FIG. 1.
Figure 3:
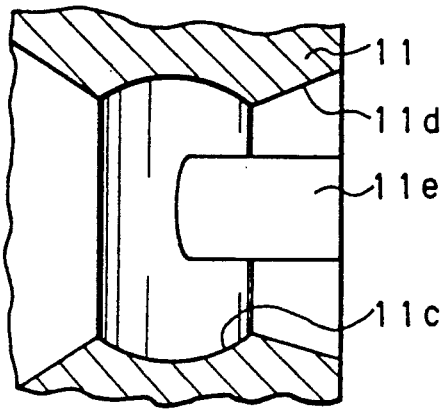
FIG. 3 is a partial cross-section of the swash plate base, taken along the line III—III of FIG. 2A.
Figure 4:
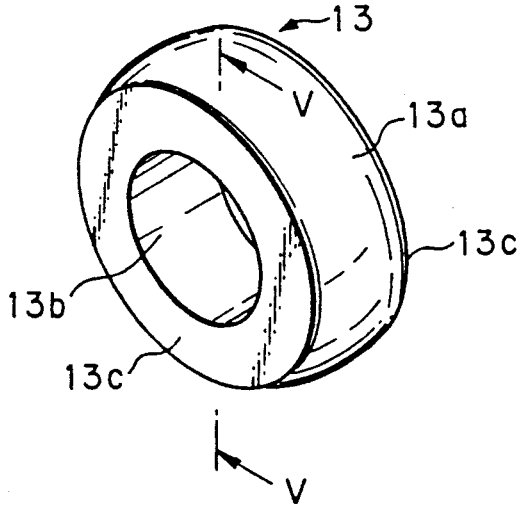
FIG. 4 is a perspective view of a hinge-ball element of the present invention.
Figure 5:
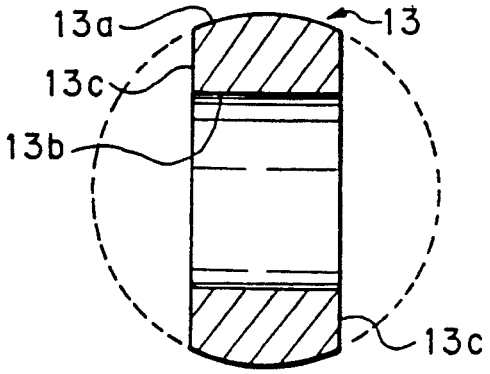
FIG. 5 is a cross-sectional view of the hinge-ball element, taken along the line V—V of FIG. 4.

Referring now to FIGS. 2A and 3, the spherical and conical wall regions 11c and 11d of the swash plate base 11 are provided with a pair of diametrically opposed guide recesses 11e formed so as to permit the hinge-ball 13 to be inserted therethrough into the central bore 11b of the swash plate base 11 at the assembly stage. More specifically, as best shown in FIG. 2A, one of the pair of diametrically opposed guide recesses 11e is arranged at one position 90 degrees apart from the top dead center (T.D.C) of the swash plate 15 in the direction reverse to the rotating direction of the swash plate 15, shown by an arrow P, and the other is arranged at the other position 90 degrees apart from the bottom dead center (B.D.C) of the swash plate 15 in the direction reverse to the rotating direction P of the swash plate 15. Respective guide recesses 11e are formed so as to extend axially from the rearmost end of the swash plate base 11 toward the interior of the central bore 11b, and to have an equivalent width substantially corresponding to the thickness of the hinge-ball 13 (FIG. 4). The guide recesses 11e are further formed so as to have an equivalent radial depth, and to have a condition such that the bottoms of respective guide recesses lie in a cylindrical face having a diameter equal to the diameter of the hinge-ball 13. Thus, as understood from the illustration of FIG. 3, the axially innermost ends of the recesses 11e terminate at the center of the spherical wall region 11c of the inner wall of the swash plate base 11.

The method of assembling the hinge-ball 13 in the swash plate base 11 will be described later by referring to FIG. 2B, which illustrates a state wherein the hinge-ball 13 is assembled in the swash plate base 11, and seated in the spherical wall region 11c of the inner wall of the swash plate base 11.

Referring again to FIG. 1, the hinge-ball 13 is mounted on the drive shaft 4 so as to be disposed radially between the drive shaft 4 and the swash plate base 11. The hinge-ball 13 is provided with an axial through-bore 13b bored through the center of the hinge-ball 13 so as to permit the drive shaft 4 to extend therethrough. As best shown in FIG. 4, the hinge-ball 13 is also provided with a pair of opposite flat faces 13c disposed symmetrically with respect to a plane extending perpendicularly to the axis of the above-mentioned axial through-bore 13b and passing the middle position of a spherical outer face 13a of the hinge-ball 13. Namely, both flat faces 13c are disposed at an equal distance from the above-mentioned plane passing the middle position of the spherical outer face 13a.

The hinge-ball 13 is axially slidable on the drive shaft 4 and is constantly subjected to elastic forces of springs 20 and 21 arranged on both sides of the hinge-ball 13.

Figure 2B:
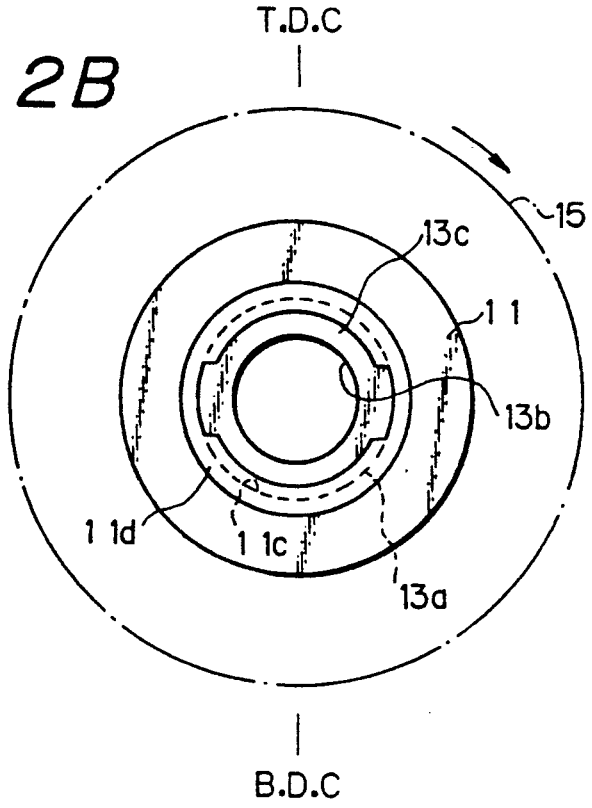
FIG. 2B is a similar front view of the swash plate base, illustrating a state wherein a hinge-ball element of the present invention is assembled therein.

Referring now to FIGS. 2A and 2B, when the hinge-ball 13 is assembled in the swash plate base 11, before insertion of the hinge-ball 13 into the central bore 11b of the swash plate base 11, the hinge-ball 13 is initially set at a posture wherein a vertical relationship is established between the axis of the through-bore 13b of the hinge-ball 13 and that of the central bore 11b of the swash plate base 11. Subsequently, the hinge-ball 13 is gradually inserted into the central bore 11b of the swash plate base 11 from the rearmost end of the swash plate base 11 in a manner such that the flat faces 13c of the hinge-ball 13 are guided by the guide recesses 11e. When the hinge-ball 13 reaches a position where the spherical outer face 13a of the hinge-ball 13 faces the spherical wall region 11c of the central bore 11b of the swash plate base 11, the hinge-ball 13 is turned about an axis perpendicular to the axis of the central bore 13b thereof through approximately 90 degrees until the hinge-ball 13 is erected and seated in the spherical wall region 11c. As a result, the hinge-ball 13 is assembled in the swash plate base 11. FIG. 2B illustrates the hinge-ball 13 assembled in the spherical wall region 11c of the swash plate base 11, and the spherical contact of the hinge-ball 13 with the spherical wall region 11c of the swash plate base 11 is accomplished. The insertion of the drive shaft 4 into the central bore of the hinge-ball 13 is carried out after the above-mentioned assembly of the hinge-ball 13 and the swash plate base 11.

The swash plate 15 of the swash plate assembly M rotating with the drive shaft 4 is able to change an angle of inclination with respect to a plane perpendicular to the axis of the drive shaft 4 due to an arrangement of the hinge-ball 13 and the afore-mentioned hinge mechanism K.

Referring again to FIG. 1, the rear housing 3 of the compressor houses a control valve 22 for controlling a pressure level in the crank chamber 2*a*. The construction and operation of the control valve 22 are known in the art and disclosed in e.g., U.S. Pat. No. 4,729,719 to Kayukawa et al.

The operation of the variable capacity swash plate type compressor according to the embodiment of the present invention will be briefly described below.

When the drive shaft 4 is rotated together with the swash plate assembly M, the swash plate 15 is rotated about the axis of the drive shaft 4, the piston elements 19 are reciprocated in the corresponding cylinder bores 1*a* via the operative engagement of the swash plate 15 and the piston elements 19 via the shoes and socket shoes 17 and 18. Thus, the refrigerant gas before compression is drawn from the suction chamber 3*a* of the rear housing 3 into respective cylinder bores 1*a*, and compressed by the piston elements 19 in the cylinder bores 1*a*. The compressed refrigerant gas is discharged by the discharging stroke of the respective piston elements 19 from the cylinder bores 1*a* toward the discharge chamber 3*b*. The capacity of discharge of the compressed refrigerant gas from the cylinder bores 1*a* toward the discharge chamber 3*b* is controlled and determined by a pressure level prevailing in the crank chamber 2*a*, and the pressure level is controlled by the control valve 22.

For example, when the pressure level in the crank chamber 2*a* is set at a given low pressure level by the operation of the control valve 22, a back pressure acting on the piston elements on the side opposite to the pressing end of each of respective piston elements 19 is low, and accordingly, the angle of inclination of the swash plate 15 of the swash plate assembly M increases. Namely, when the back pressure acting on the piston elements 19 is low, the ball 9 is slid in the socket element 8 so that the guide pin 10 is generally displaced frontward. Therefore, the swash plate base 11 is turned about the hinge-ball 13 in the clockwise direction in FIG. 1. Simultaneously, the hinge-ball 13 is slid toward the frontward against the elastic force of the spring 21 arranged between the hinge-ball 13 and the rotary support 5. Thus, the guide pin 10 of the hinge mechanism K is moved in the bore 9*a* of the ball 9 so as to increase an amount of projection thereof from the support arm 6. Consequently, the angle of inclination of the swash plate 15 increases, and therefore the socket shoes 18 slidably engaged with the cylindrical shoes 17 are radially moved in the cuts 19*a* of the pistons 19 so as to increase the reciprocation stroke of the pistons 19. Thus, the capacity of discharge of the compressed refrigerant gas is increased.

On the other hand, when the control valve 22 stops a fluid communication between the suction chamber 3*a* and the crank chamber 2*a*, the pressure level prevailing in the crank chamber 2*a* is raised by a blow-by gas leaking out of the cylinder bores 1*a*. Thus, a large back pressure acts on the respective piston elements 19 so as to reduce the angle of inclination of the swash plate 15. Namely, in the hinge mechanism k, the ball 9 is slid in the socket 8 so that the guide pin 10 is generally displaced rearward. Accordingly, the swash plate base 11 is turned around the hinge-ball 13 in the counterclockwise direction in FIG. 1. Simultaneously, the hinge-ball 13 is slid on the drive shaft 4 toward the rearward against the elastic force of the spring 20 arranged between the hinge-ball 13 and the central bore of the cylinder block 1. Consequently, the guide pin 10 of the hinge mechanism K is moved in the guide bore 9*a* so as to reduce an amount of projection from the support arm 6. As a result, the angle of inclination of the swash plate 15 is reduced so that the socket shoes 18 is radially moved in the cuts 19*a* of the piston elements 19 via the sliding engagement of the shoes 17 and the socket shoes 18. Thus, the reciprocation stroke of the piston elements 19 is reduced. Accordingly, the capacity of discharge of the compressed refrigerant gas is reduced.

Figure 6:
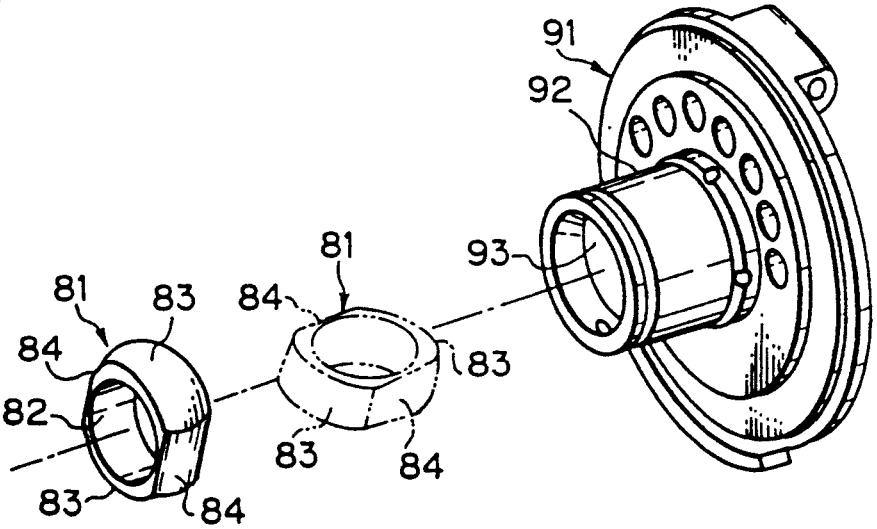
Fig. 6 (PRIOR ART)
FIG. 6 is an exploded view of the hinge-ball element and the swash plate base according to the prior art.

In accordance with the compressor of the embodiment of the present invention, the hinge-ball 13 has a single spherical outer face 13*a*, and accordingly, the production of the hinge-ball 13 is very simply compared with the conventional hinge-ball having spherical and cylindrical outer faces as shown in FIG. 6, and therefore the production cost of the hinge-ball 13 can be less than that of the conventional hinge-ball.

Further, the location of the guide recesses 11*e* of the swash plate base 11 is selected so as to be distant apart 90 degrees with respect to the top and bottom dead centers of the swash plate 15 in the direction reverse to the rotating direction of the swash plate 15 during the operation of the compressor. At this stage, the top dead center of the swash plate 15 designates the position where the swash plate 15 is able to bring respective piston elements 19 toward the end of the compression stroke of the piston elements 19.

When the top dead center of the swash plate 15 of the swash plate assembly M is rotated to a position in an exact alignment with one of the plurality of cylinder bore 1*a*, the discharge of the compressed refrigerant gas from the cylinder bore 1*a* toward the discharge chamber 3*b* is completed, and the suction of the refrigerant gas starts shortly. Therefore, although the swash plate 15 is always subjected to various reacting forces given by each of respective reciprocating piston elements 19, the top dead center of the swash plate 15 is not subjected to the largest force. At this stage, each of the above-mentioned different reacting forces consists of a combinations of the gas compression reaction force and the gas suction force. The largest reacting force always acts on the position of the swash plate 15 located apart some scores of degrees from the top dead center in the direction reverse to the rotating direction of the swash plate 15.

In the described embodiment of the present invention, the location of the guide recesses 11*e* of the swash plate base 11 are selected so as not to be the same as the above-mentioned position of the swash plate 15 subjecting to the largest reacting force. Accordingly, the spherical engagement of the hinge-ball 13 and the swash plate base 11 can ensure that the largest reacting force acting on the swash plate assembly M through the swash plate 15 can be eventually assumed by the spherical outer face 13*a* of the hinge-ball 13. Namely, the existence of the guide recesses 11*e* of the swash plate base 11 does not adversely affect on the force supporting function of the hinge-ball 13. Consequently, little, if any, noise problem occurs during the operation of the compressor.

From the foregoing description of the preferred embodiment of the present invention, it will be understood that the variable capacity swash plate type compressor of the present invention can be a low manufacturing cost compressor due to the employment of the less expensive hinge-ball having a single spherical outer face and the swash plate base having a pair of guide recesses allowing an easy assembly of the hinge-ball in the swash plate assembly.

I claim:

1. A variable capacity swash plate type refrigerant compressor including:

a compressor housing means defining therein a suction chamber for receiving a refrigerant gas to be compressed, a discharge chamber for receiving the refrigerant gas after compression, a crank chamber capable of functioning as a capacity control chamber, and a plurality of cylinder bores;

a plurality of piston elements received in the cylinder bores of said compressor housing means to be reciprocated therein, said piston elements having one end acting as compressing head and the other end axially opposite to said compressing head, respectively;

an axial drive shaft rotatably supported by said compressor housing means, and extended axially through said crank chamber of said compressor housing means;

a rotary support means fixed to said axial drive shaft so as to be rotated together with said drive shaft within said crank chamber, said rotary support means being provided with a support arm thereof arranged in said crank chamber;

a hinge-ball means axially slidably mounted on said axial drive shaft;

a swash plate means in the form of a generally hollow cylindrical means mounted around said drive shaft and pivotally connected to said support arm of said rotary support means, said swash plate means being slidably engaged with said hinge-ball means so as to change an angle of inclination thereof with regard to a plane perpendicular to the axis of said axial drive shaft, and provided with a disk-like swash plate operatively connected to the plurality of piston elements so as to reciprocate said piston elements in said cylinder bores in response to the rotation of said drive shaft, and;

a control means for controlling a pressure level prevailing in said crank chamber and capable of adjustably changing the angle of inclination of said swash plate means to thereby vary the compression and discharge capacity of the compressor;

wherein said hinge-ball means is provided with single spherical outer face spherically engageable with a central bore of said swash plate means, a central bore in which said axial drive shaft is slidably fit, and a pair of axially opposite flat faces arranged symmetrically with regard to a plane perpendicular to the axis of the central bore of said hinge-ball means and extending through the middle position of said single spherical outer face, and wherein said swash plate means in the form of the hollow cylindrical means is provided with a central bore enclosed by an inner axially extending wall, said inner axial wall of said swash plate means being provided with at least a spherical wall region capable of being spherically engaged with said single spherical outer face of said hinge-ball means, and a pair of guide recesses for permitting said hinge-ball means to be inserted into said central bore of said swash plate means from an end thereof in such a manner that said flat faces of said hinge-ball means are slidably guided by said guide recesses when said hinge-ball means is assembled in said swash plate means.

2. A variable capacity swash plate type refrigerant compressor according to claim 1, wherein the pair of guide recesses of said swash plate means are formed so as to extend axially from the end of said swash plate means to the middle of said spherical wall region of said swash plate means, the width of the pair of guide recesses being substantially equal to the thickness between said flat faces of said hinge-ball means.

3. A variable capacity swash plate type refrigerant compressor according to claim 2, wherein said guide recesses of said swash plate means are formed so as to have a cylindrical bottom, respectively, lying in a circle having a diameter substantially corresponding to a diameter of said single spherical outer face of said hinge-ball means.

4. A variable capacity swash plate type refrigerant compressor according to claim 1, wherein the pair of guide recesses of said swash plate means are arranged in such a manner that they are located 90 degrees apart from top and bottom dead center of said swash plate in the direction reverse to the rotating direction of said swash plate means.

* * * * *